US005115970A

United States Patent [19]

Rice et al.

[11] Patent Number: 5,115,970

[45] Date of Patent: May 26, 1992

[54] SWITCH POINT GUARD RAIL

[75] Inventors: Paul P. Rice; William D. Munch, both of Harrisburg, Pa.

[73] Assignee: Bethlehem Steel Corporation, Bethlehem, Pa.

[21] Appl. No.: 583,776

[22] Filed: Sep. 14, 1990

[51] Int. Cl.[5] ..... E01B 5/00

[52] U.S. Cl. ..... 238/17; 246/435 A; 246/456; 238/20

[58] Field of Search ..... 238/17, 20; 246/385, 246/387, 389, 391, 422, 435 A, 441, 456

[56] References Cited

U.S. PATENT DOCUMENTS

| | | | |
|---|---|---|---|
| 1,161,741 | 11/1915 | Smoter | 238/17 X |
| 1,163,431 | 12/1915 | Maranda et al. | 238/20 |
| 1,230,533 | 6/1917 | Stiles | 238/20 |
| 1,463,943 | 8/1923 | Fallon | 238/20 |
| 1,872,848 | 8/1932 | Told | 238/336 |
| 3,026,074 | 3/1962 | Kern | 238/22 |
| 3,063,641 | 11/1962 | Frey | 238/336 |
| 4,386,751 | 6/1983 | Meyer | 238/22 |
| 4,566,630 | 1/1986 | Keiper | 238/292 |
| 4,738,418 | 4/1988 | Farrell | 246/441 |

*Primary Examiner*—Frank E. Werner
*Assistant Examiner*—James Eller
*Attorney, Agent, or Firm*—Harold I. Masteller, Jr.

[57] ABSTRACT

An adjustable switch point guard rail assembly for use adjacent the switch point of a railway switch. The adjustable guard rail assembly is comprised of a plurality of support chairs and an adjustable guard rail. The adjustable guard rail includes a surface for engaging and laterally urging the wheels of rolling stock in a direction toward the centerline of the trackwork. Also disclosed is an apparatus for laterally adjusting and fastening the wheel engaging surface of the adjustable guard rail to a variety of positions toward or away from the switch point within a given range of lateral movement.

6 Claims, 3 Drawing Sheets

SWITCH POINT GUARD RAIL

BACKGROUND OF THE INVENTION

This invention relates to adjustable switch point guard rails for use adjacent the switch point of railway switches in trackwork. It relates specifically to adjustable guard rails having a surface for engaging and laterally urging the moving wheels of rolling stock in a direction toward the centerline of the trackwork where the wheel engaging surface is capable of adjustment to a variety of positions toward or away from the switch point of the trackwork.

The switching rail of a railway switch assembly includes a tapered rail portion which terminates into a thin end point for intercepting and switching the wheels of rolling stock from one rail onto another. To prevent the wheels of the rolling stock from damaging these thin end portions of the switching rails, guard rails are used to engage and urge the wheels in a lateral direction toward the centerline of the trackwork. This lateral displacement of the wheels avoids contact between the wheel flanges and the thin end of the tapered section of the switching rail and transfers the initial contact between the wheels and switching rail to some point along the rail where the rail section is thicker.

Because such switch point guard rails experience considerable wear due to the repeated contact between the moving wheels and the wheel engaging surface of the guard rail, and because proper placement of the guard rail with respect to the switch point is critical, it is desirable to provide means to adjust the switch point guard rail toward or away from the switch point. Such adjustment means enables initial proper placement of the guard rail adjacent the switch point and later adjustment as the wheel engaging surface is worn away by the wheels.

Adjustable switch point guard rails have been used in the past to extend guard rail life. U.S. Pat. Nos. 4,738,418 and 4,386,751, granted to Farrell and Meyer respectively, disclose adjustable switch point guard rails. However, these patents disclose adjustment to a predetermined, limited number of lateral adjustments. Farrell provides three fixed adjustments positions while Meyer provides only two such adjustments. The predetermined, fixed adjustments positions shown in both of the prior patents greatly limits the precision of the guard rail adjustment means. Both inventors fail to provide fine, accurate, positioning of the guard rail with respect to the switch point of the railway switch. In addition, because the adjustment means shown in the two prior patents provide only one and two fixed, predetermined, guard rail wear adjustments, the service life of the adjustable guard rail is greatly limited. In order to overcome the aforementioned limitations of prior adjustable guard rails, an adjustable guard rail assembly must include means for adjusting and fastening the adjustable guard rail to a variety of positions toward or away from the switch point within a given range of lateral movement.

SUMMARY OF THE INVENTION

It is therefore an object of this invention to provide an adjustable guard rail assembly for use adjacent the switch point of a railway switch including an adjustable guard rail having a wheel engaging surface for engaging and urging the moving wheels of rolling stock toward the centerline of the trackwork.

It is a further object of this invention to provide an adjustable guard rail having adjustment means for accurately placing the wheel engaging surface of an adjustable guard rail adjacent the switch point of a railway switch.

It is still a further object of this invention to provide guard rail adjustable means which provides variable adjustment of the guard rail to any position within a given of lateral movement.

It is still further object of this invention to provide fastening means for securing an adjustable guard rail at any position within a given range of lateral movement.

I have discovered that the foregoing objectives can be attained using an adjustable guard rail assembly comprising a plurality of support chairs attached to the tie plates of trackwork, each support chair having a raised portion and a wedge shaped member including a vertical friction surface for engaging the wheels of rolling stock and a rear portion including a plurality of tail pieces corresponding to the plurality of support chairs, and a wedge shaped member including a vertical friction surface for engagement with the vertical friction surface of the wedge shaped member of its corresponding support chair and, fastening means for attaching each tail piece of the adjustable guard rail to each corresponding support chair.

DESCRIPTION OF THE PREFERRED EMBODIMENT

Figure 1:
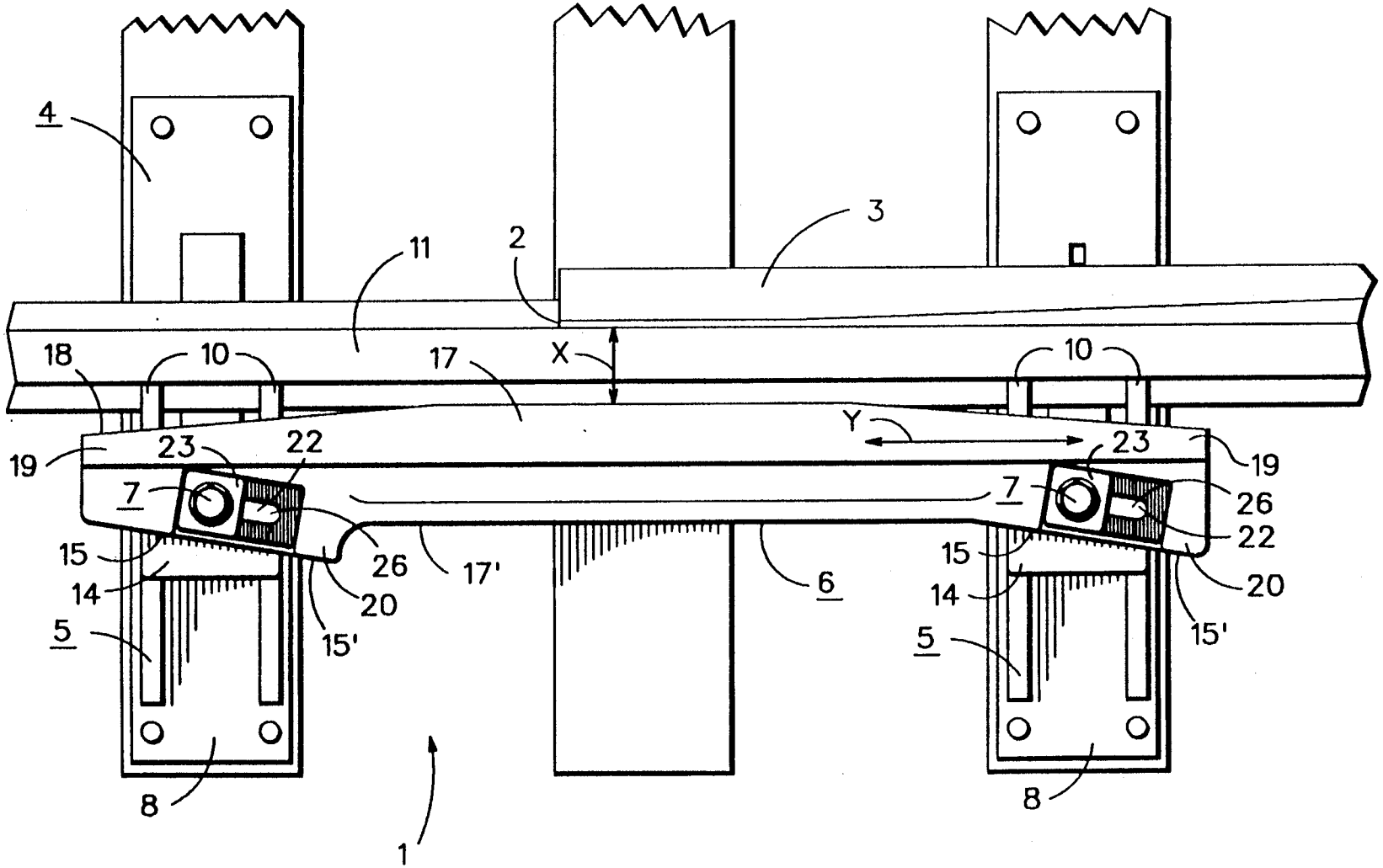
FIG. 1 is a plan view of the preferred embodiment of the adjustable guard rail of the present invention.
Figure 2:
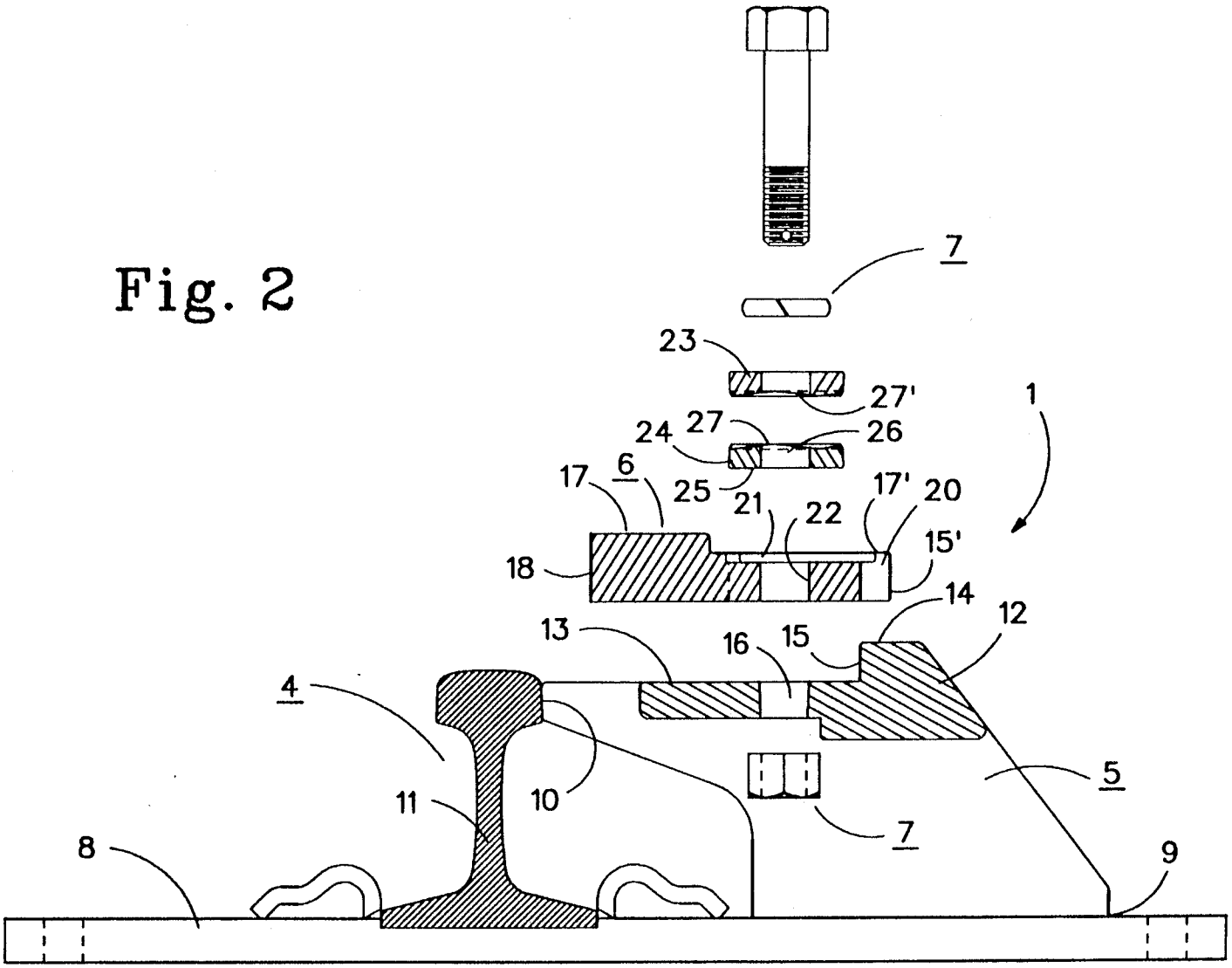
FIG. 2 is an exploded, cross-section view of the present invention.
Figure 3:
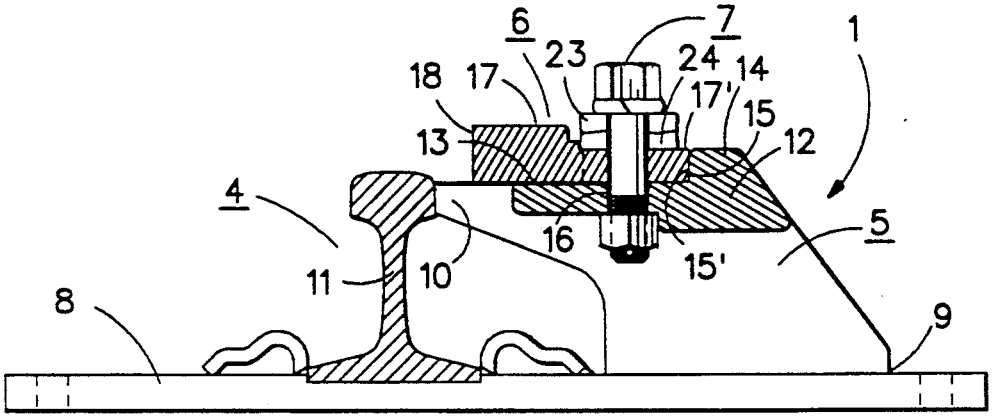
FIG. 3 is an elevational view of the preferred embodiment in cross-section.

Referring to FIGS. 1 through 3 of the drawings, an adjustable guard rail assembly 1 is shown located adjacent the switch point 2 of a switching rail 3 of a switch assembly for trackwork 4. The adjustable guard rail assembly comprises a plurality of support chairs 5, an elongated adjustable guard rail 6 and a plurality of fastening means 7.

The support chairs 5 of the adjustable guard rail assembly 1 are positioned and attached, by welding or any suitable means to tie plates 8 of the trackwork 4 at a gaged distance from the main trackwork rail 11. Each support chair 5 includes base portion 9 for attachment to its individual tie plate 8, nose portions 10 for bother laterally bracing the main trackwork rail 11 and gaging the support chair distance from the main rail 11, and an elevated portion 12. Elevated portion 12 includes a raised surface 13 providing means for supporting an adjustable guard rail 6 at a suitable elevation for engaging the wheels of the rolling stock, a wedge shaped portion 14 including a vertical friction engaging surface 15 for frictionally engaging the adjustable guard rail 6, and an aperture 16 for receiving fastening means 7 for fastening the adjustable guard rail 6 to the support chair 5.

The adjustable guard rail 6 comprises an elongated rail having a thicker front portion 17, and a thinner rear portion 17'. Front portion 17 includes a wheel engaging surface 18, and tapered ends 19 for engaging and laterally urging incoming wheels of rolling stock toward the centerline of the trackwork. The thinner rear portion 17' includes a plurality of tail pieces 20, each tail piece 20 extends from the rear portion 17' in a direction away from the wheel engaging surface 18.

The adjustable guard rail 6, further includes adjustment means to laterally adjust the guard rail to a plurality of positions toward or away from the trackwork, within a given range of lateral movement. The adjustment means includes a vertical friction engaging surface 15', provided along one edge of each tail piece 20, and a plurality of cooperating recesses or pockets 21, located within the top surface of the thinner back portion 17'. Each friction engaging surface 15' is angled toward the wheel engaging surface 18 of the guard rail to provide a continual engagement with a corresponding friction surface 15, of a support chair 5, as the guard rail 6 is moved to any selected position within the given range of lateral movement toward or away from the trackwork. As shown in FIG. 3, each recess or pocket 21, includes an elongated aperture 22 parallel to the vertical friction engaging surface 15' of the adjustable guard rail 6. The recess 21 and the elongated aperture 22 are adapted to receive fastening means 7 to provide means for fastening the adjustable guard rail 6 to the support chair 5.

Fastening means 7 includes a nut, bolt and lock washer, in combination with a serrated washer 23 and serrated friction plate 24. The serrated friction plate includes a bottom surface 25 shaped for mating engagement with the recesses 21 in each tail piece 20 of the adjustable guard rail 6, an elongated aperture 26 corresponding to elongated apertures 22 of the recesses 21, and an upper surface having upwardly pointing serrations 27 for frictional engagement with downwardly pointing serrations 27' of serrated washer 23.

Figure 4:
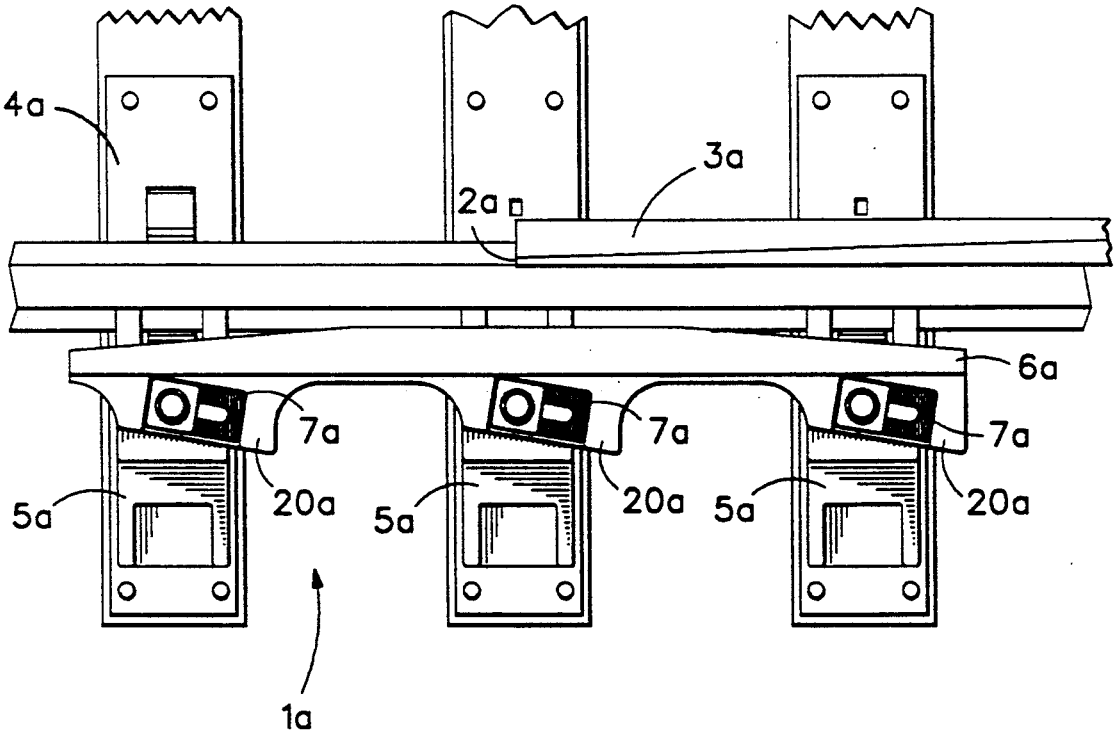
FIG. 4 is a plan view of an alternate embodiment of the present invention.

Referring to FIG. 4 of the drawings, an alternate embodiment of the adjustable guard rail assembly is shown at 1*a* located adjacent the switch point 2*a* of a switching rail 3*a* of a switch assembly for trackwork 4*a*. The adjustable guard rail assembly comprises a plurality of support chairs 5*a*, an elongated adjustable guard rail 6*a*, including a plurality of tail pieces 20*a*, and a plurality of fastening means 7*a*.

The adjustable switch point guard rail assembly of the present invention provides a simplified, accurate method for installation and adjustment of the guard rail.

During initial installation of the adjustable guard rail assembly, each support chair 5 is positioned on its individual tie plate 8 adjacent the switch point portion 2 of a railway switch assembly. Each support chair is correctly positioned with respect to the trackwork 4 by placing the support chair nose portion 10 directly against the outer sides of the rail head of the main rail 11, as shown in FIG. 2, and the base portion 9 of each support chair 5 is fixed to a tie plate 8 by welding or other suitable means well-known in the art.

The adjustable guard rail 6, of the adjustable switch point guard rail assembly 1, is placed to extend across the raised surfaces 13 of the plurality of support chairs 5 and adjustable guard rail 6 is then positioned to align each elongated aperture 22 of each tail piece 20 with its corresponding aperture 16 in the support chairs 5. With apertures 22 and 16 aligned, fastening means 7 are installed by placing a friction plate 24, having upward point serrations, into each recess 21 of tail pieces 20. Next, washers 23, having their serrations extending in a downward direction, are installed to engage the upwardly extending serrations of friction plate 24. The bolts, nuts and lock washers of the fastening means 7 are then installed to loosely attach the adjustable guard rail 6 to the support chairs 5 to permit longitudinal sliding movement between the vertical friction engaging surfaces 15 and 15' of the support chairs 5 and the adjustable guard rail 6.

As shown in FIG. 1 of the drawings, the correct gage distance X, the distance between the wheel engaging surface 18 of thicker front portion 17 of the adjustable guard rail 6 and the switch point 2, is established and the adjustable guard rail 6 is adjusted accordingly by moving the adjustable guard rail 6 in a longitudinal direction Y causing the wedging action between the friction engaging surfaces 15 and 15' to adjust guard rail 6 toward or away from the main rail 11 of the trackwork 4. The adjustable guard rail 6 is adjusted laterally to its proper gage distance X and the fastening means 7 are tightened to prevent further movement of the adjustable guard rail 6.

To readjust the adjustable guard rail 6 after the wheel engaging surface 18 has been worn by repeated contact with the wheels of rolling stock, fastening means 7 are loosened but not removed from the adjustable guard rail assembly, the adjustable guard rail 6 is moved in the longitudinal direction Y until wheel engaging surface 18 is laterally moved toward main rail 11 to the proper gage distance X, and fastening means are tightened to prevent further movement of adjustable guard rail 6. The lateral repositioning of the wheel engaging surface 18 of adjustable guard rail 6 is a simple operation requiring no disassembly of the switch point guard rail assembly 1, and the adjustment can repeated a number of times until the thicker front portion 17 of adjustable guard rail 6 is worn beyond its effective use.

We claim:

1. In a switch point guard rail assembly including a guard rail and a plurality of chairs, each chair having a vertical surface for engaging and supporting said guard rail against lateral movement adjacent a railway switch, wherein the improvement comprises an adjustable guard rail comprising:

(a) a front portion, having a wheel engaging surface, and (c) a thinner back portion including;

(i) two or more spaced apart tail pieces positioned along the length of said adjustable guard rail, each said tail piece extending from said thinner back portion in a direction away from said wheel engaging surface, and each said tail piece including a friction engaging surface for providing continuous engagement with said vertical surface of said chairs as said adjustable guard rail is adjusted to any selected positioned toward or away from said switch point, and (ii) a top surface including two or more recessed portions, formed within said top surface, each said recessed portion having an elongated aperture extending through said thinner back portion and each aperture being elongated in a direction parallel to said friction engaging surfaces of said tail pieces.

2. The invention recited in claim 1 wherein said friction engaging surfaces are angled toward said wheel engaging surface.

3. The invention recited in claim 1 wherein each recessed portion is parallel to said friction engaging surfaces of the tail pieces.

4. The invention recited in claim 1 wherein each recessed portion is adapted to receive an adjustable fastening means comprising:

(a) a first friction plate having a configuration shaped to fit within said recess portion, said friction plate including an elongated aperture corresponding to said elongated aperture of said recessed portion, and a top surface having a plurality of upward pointing serrations, (b) a second, smaller friction plate including an aperture communicating with said elongated aperture of said first friction plate, and a bottom surface having a plurality of downward pointing serrations for engagement with said upward pointing serrations of said first friction plate.

5. The invention recited in claim 4 wherein said serrations are perpendicular to said wheel engaging surface.

6. The invention recited in claim 4 wherein said adjustable fastening means includes a threaded fastener extending through said first and said second friction plates, said threaded fastener provides means for attaching said adjustable guard rail to said chairs.

* * * * *